US005184852A

United States Patent [19]

O'Brien

[11] Patent Number: 5,184,852

[45] Date of Patent: Feb. 9, 1993

[54] ROD AND CASE ASSEMBLY

[75] Inventor: James O'Brien, Burbank, Calif.

[73] Assignee: Thomas Industries Inc., Builders Brass Works Division, Los Angeles, Calif.

[21] Appl. No.: 734,566

[22] Filed: Jul. 23, 1991

[51] Int. Cl.[5] ..... E05C 15/02

[52] U.S. Cl. ..... 292/40; 292/153; 292/169; 292/DIG. 24; 292/DIG. 62

[58] Field of Search ..... 292/21, 92, 40, 37, 292/34, 165, 173, 169, 336.3, DIG. 24, DIG. 62

[56] References Cited

U.S. PATENT DOCUMENTS

| | | | |
|---|---|---|---|
| 1,495,820 | 5/1924 | Tierney | 292/DIG. 62 X |
| 1,548,371 | 8/1925 | Moore | 292/DIG. 24 X |
| 3,455,591 | 7/1969 | Powers | 292/40 X |
| 3,498,657 | 3/1970 | Fontana | 292/34 |
| 3,776,582 | 12/1973 | Balducci | 292/92 |
| 3,894,759 | 7/1975 | Balducci | 292/92 |
| 3,993,335 | 11/1976 | Schmidt | 292/21 |
| 4,225,163 | 9/1980 | Hubbard et al. | 292/21 |
| 4,283,882 | 8/1981 | Hubbard et al. | 49/141 |
| 4,368,905 | 1/1983 | Hirschbein | 292/5 |
| 4,488,378 | 12/1984 | Symon | 49/141 |
| 4,498,319 | 2/1985 | Balducci et al. | 70/92 |
| 4,545,606 | 10/1985 | Vodra | 292/92 |
| 4,839,988 | 6/1989 | Betts et al. | 49/141 |
| 4,906,034 | 3/1990 | Verslycken | 292/92 |

*Primary Examiner*—Richard E. Moore
*Attorney, Agent, or Firm*—Hill, Steadman & Simpson

[57] ABSTRACT

A rod casing for activating vertically arranged latch bolts, the casing and latch bolts arranged in an active stile of a door and engageable to a door frame. The rod casing provides a vertically slidable actuator cam engageable by both a lock/unlock actuator and a delatch or dogging actuator. The lock/unlock actuator and the delatch actuator are rotatably mounted upon a spindle piece which itself is rotatable by a user such as by a key-activated lock cylinder. The lock/unlock actuator when rotated slidingly abuts the actuator cam and drives the actuator cam vertically upward to cause unlatching of the latch bolts. The delatch actuator, upon rotation of the spindle piece in an opposite direction underlies the actuator cam and dogs the actuator cam in its vertically risen position. To deactivate the delatch actuator, the lock/unlock actuator can be rotated to interfere and displace the delatch actuator to release the actuator cam from the dogging position. The actuator cam is composed of a resilient material to allow the delatch actuator to engage the actuator cam in a spring-like or resiliently compressible fashion to help hold the actuator cam in its dogging position.

29 Claims, 3 Drawing Sheets

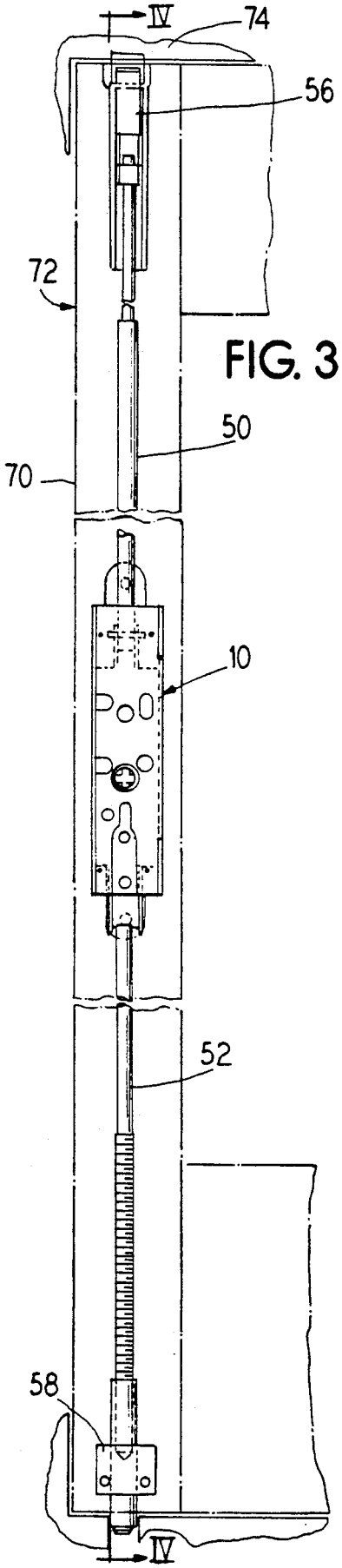
FIG. 3
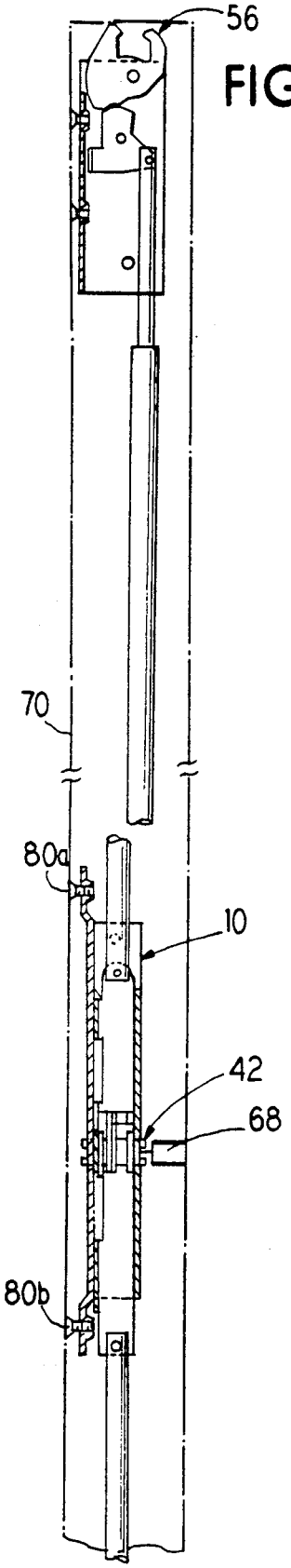
FIG. 4
FIG. 2
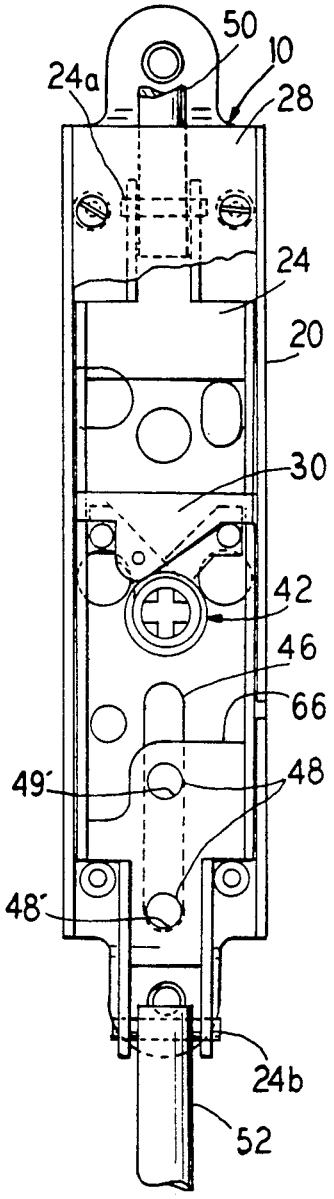

10
20
24
30
30a
34
34b
38
38b
42
50
52
XIII

ROD AND CASE ASSEMBLY

BACKGROUND OF THE INVENTION

The present invention relates to a case assembly or mechanism for activating and deactivating vertically operating bolts extending from the top and bottom of a door stile and engageable with a door frame. In particular, the case assembly is activated by a key and key cylinder or a panic exit bar or other device for raising a bottom bolt and retracting an upper bolt or disengaging an upper and lower latch to allow the door to freely swing open. The present invention particularly relates to a means of retracting the upper and lower latch bolts and a means for "dogging" or selectively holding the latch bolts or latches in their retracted or disengaged position.

A variety of dogging devices are known in the prior art. These dogging devices selectively hold latches in a retracted position. Such dogging devices are disclosed, for example, in U.S. Pat. No. 3,993,335, U.S. Pat. No. 3,374,649, and U.S. Pat. No. 4,624,490.

SUMMARY OF THE INVENTION

It is an object of the present invention to provide a compact, easily manufactured, rod and case assembly for both unlocking or disengaging the upper and lower latches from a door frame and also dogging the latches in their disengaged condition.

It is an object of the invention to provide the rod and case assembly for installation in an active door stile of a door and provide key activation of both the unlocking feature and the dogging feature of the case and rod assembly.

It is an object of the invention to provide a simple rod and case assembly having minimum of parts.

It is an object of the invention to provide a rugged, durable rod and case assembly for unlocking and, additionally, dogging vertical latches.

The objects of the invention are inventively achieved in that a rod and case assembly is provided with a casing assembly engaged to vertically extending rods, the rods engaged to upper and lower latches for engaging and disengaging a door frame. The casing assembly provides a lock/unlock and retract cam fixed to a rod slide movable vertically within a housing. The housing is anchored within the door stile. The lock/unlock retract cam is activated by a lock/unlock actuator which can be key operated or mechanically operated, such as by a panic exit device. The lock/unlock retract cam is also engageable by a latch retract actuator which is engageable with the lock/unlock retract cam to dog the latches in a disengaged condition for convenient unlocked use of the otherwise automatically latching door.

The objects are inventively achieved in that both the latch retract actuator and the lock/unlock actuator can be engaged by a single cylinder hub for rotatable engagement and disengagement with the lock/latch retract cam.

The rod and case assembly achieves a compact and reliable configuration, easily installed, having a minimum of parts, while still being reliable and cost effective.

Conveniently utilized with the present invention is an upper latch assembly according to U.S. Ser. No. 664,797 filed Mar. 5, 1991, now U.S. Pat. No. 5,114,192, issued May 19, 1992, and a lower latch assembly such as shown in U.S. Pat. No. 4,839,988, both of which disclosures are incorporated herein by reference.

BRIEF DESCRIPTION OF THE DRAWINGS

FIG. 2 is a front elevational view of the rod casing shown in FIG. 1;

FIG. 3 is a front elevational view of the rod casing of FIG. 1 mounted inside an active door stile and having extending rods and latches;

FIG. 4 is a partial side elevational view of the casing and rod assembly of FIG. 3;

DETAILED DESCRIPTION OF THE PREFERRED EMBODIMENTS

Figure 1:
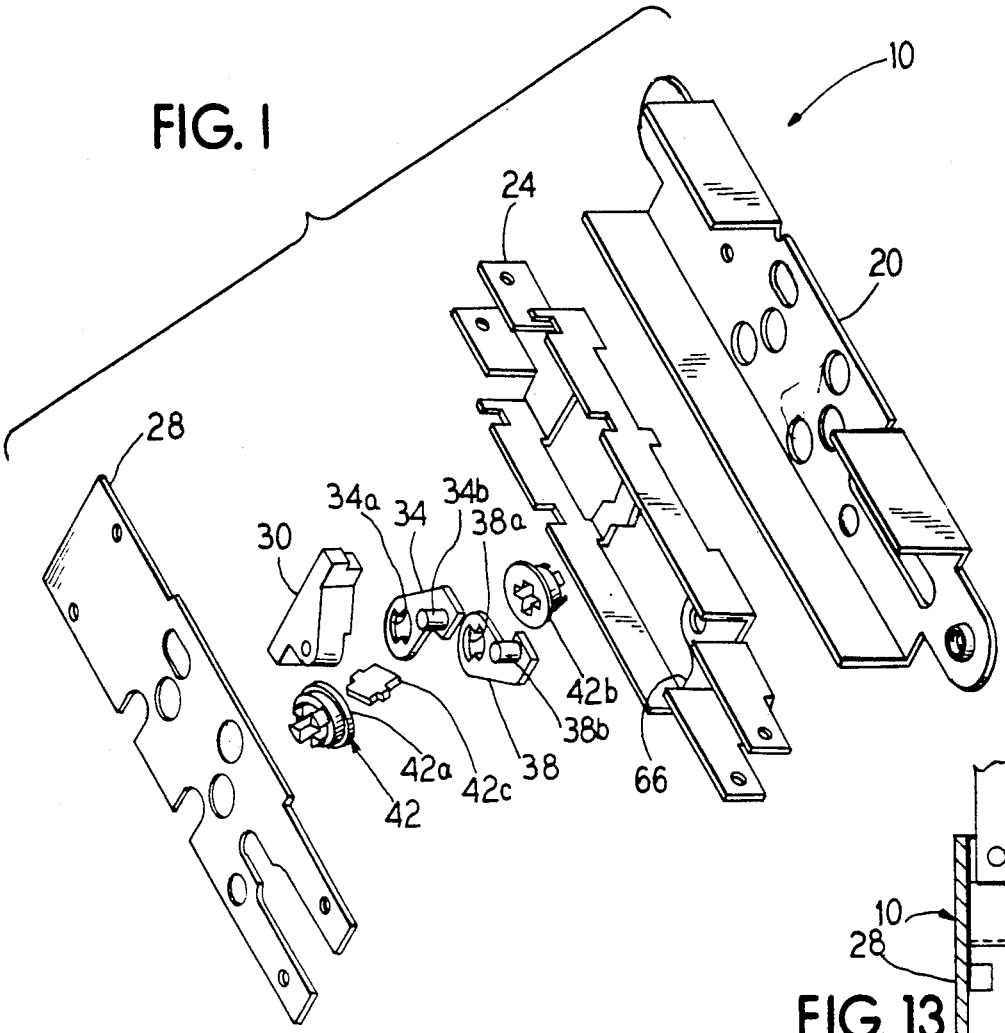
FIG. 1 is an exploded view of the rod casing of the present invention.

FIG. 1 shows an exploded view of the rod casing assembly 10 of the present invention. The casing assembly 10 comprises a chassis 20, a rod slide 24, and a cover 28. Also provided as part of the assembly is a lock/latch retract cam or actuator cam 30, a lock/unlock means such as a lock/unlock actuator 34, a delatch means such as a latch retract actuator 38, and a cylinder hub 42, comprising in exploded form a left hub 42*a*, a right hub 42*b*, and a spindle piece 42*c*.

FIG. 2 shows the rod casing assembly 10 with portions of the cover 28 removed for clarity. The rod slide 24 fits within the chassis 20 and is held therein in axially sliding fashion. The chassis 20 is provided with axial mounting slots 46 which capture two bolts or pins 48 through the rod slide 24. Therefore, the rod slide 24 can move vertically or axially with respect to the chassis 20. The rod slide 24 mounts at a top end 24*a* a first latch rod 50, and at a bottom end 24*b* a second latch rod 52 for engaging and disengaging a first latch 56 (shown in FIG. 4) and a second latch 58 (shown in FIG. 3) for latching and delatching an active stile 70 of a door 72 to a door frame 74 (shown in FIG. 3).

Mounted in a fixed manner to the rod slide 24 is the lock/latch retract cam 30. The lock/latch retract cam 30 moves vertically with the rod slide 24 within the chassis 20.

Mounted to the cover 28 and the chassis 20 and penetrating an open space 66 at a back of the rod slide 24 is the cylinder hub 42. The cylinder hub 42 acts as an interface between a key cylinder 68 (shown schematically in FIG. 4) and the rod casing assembly 10. Rotation of a key in the key cylinder 68 would impart rotation to the cylinder hub 42 about an axis into the page of FIG. 2.

The cylinder hub 42, when assembled, captures the latch retract actuator 38 and the lock/unlock actuator 34 on its axis of rotation by piercing central apertures 38*a*, 34*a* of the latch retract actuator and the lock/unlock actuator respectively (shown in FIG. 1). These central apertures 34*a*, 38*a* are pierced by the spindle piece 42*c* and are fashioned to be selectively rotatable by the spindle piece 42*c*. Thus, when the cylinder hub 42 is assembled, rotation of the cylinder hub 42 along its axis imparts selective rotation to the latch retract actuator 38 and the lock/unlock actuator 34. However, rotation of the spindle piece 42*c* within the formed apertures 34*a*. 38*a* has sufficient degree of free rotational travel with respect to the latch retract actuator 38 and lock-/unlock actuator 34 to selectively rotate the latch retract actuator 38 and the lock/unlock actuator 34 independently in order to perform the required functions.

FIG. 3 shows the rod casing assembly 10 mounted to the active stile 70 of the door 72 fit into the door frame 74. The upward latch 56 is of a type more fully described in pending application Ser. No. 664,797, filed Mar. 5, 1991, now U.S. Pat. No. 5,114,192, issued May 19, 1992, and the lower latch is more fully described in U.S. Pat. No. 4,839,988. A variety of known latches can be utilized with the present invention.

FIG. 4 shows the casing assembly 10 mounted to the door stile 70 by two screws 80*a*, 80*b*. The cylinder hub 42 is shown in a position to be engaged by the lock cylinder 68. It is to be noted from FIGS. 3 and 4 that upward movement of the rods 50, 52 disengages the latches 50, 52.

Figures 5, 6, 7, 8, 9, 10, 11:
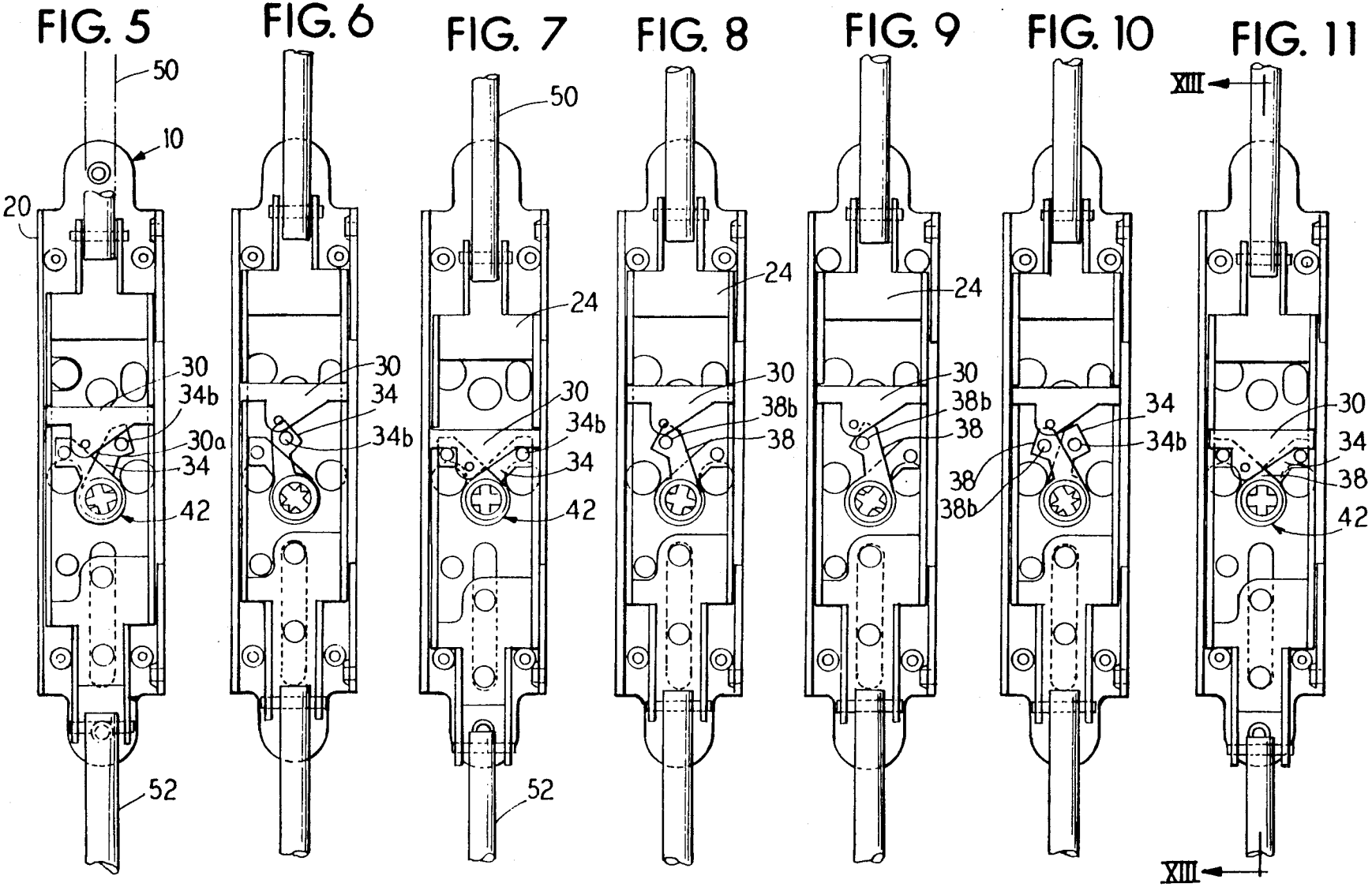
FIGS. 5–11 are front elevational views of the rod casing assembly in particular operational conditions.

FIGS. 5–11 show the rod casing assembly 10 in various stages of operation. In FIG. 5 the cylinder hub 42 is being rotated counter clockwise which causes the spindle piece 42*c* to rotate the lock/unlock actuator 34 counter clockwise. The spindle piece 42*c* abuts corners 34*c*, 34*d* to rotate the lock/unlock actuator 34 as can be derived from FIG. 12 for counter-clockwise rotation of the spindle piece 42*c*. The lock/unlock actuator 34 has extending horizontally therefrom a lock actuating pin 34*b* which slides along the cammed surface 30*a* of the cam 30, driving the cam 30 upward which drives the rod slide 24 upward, which drives the rods 50, 52 upward.

FIG. 6 shows the travel of the lock/unlock actuator 34 complete. The latches 56, 58 have been fully retracted (not shown) and the door can be opened. The cam 30 rests upon the actuating pin 34*b*.

FIG. 7 shows the cylinder hub 42 released such as when an operator of a key has released pressure on the key. By the weight of the rods 50, 52, the cam 30 has fallen down with the actuator pin 34*b* riding along the cam surface 30*a* and returning to its original position. This is an "undogged" or "latch activated" condition.

FIG. 8 shows the latch retract actuator 38 rotated clockwise with a dogging actuating pin 38*b* rotated beneath the cam 30 which had been in an elevated position. This positioning of the retract actuator 38 would generally follow the condition shown in FIG. 6 where clockwise rotation of the cylinder hub from the condition of FIG. 6 would permit the retract actuator 38 to displace the lock/unlock actuator 34 to underlie the cam 30.

Figure 12:
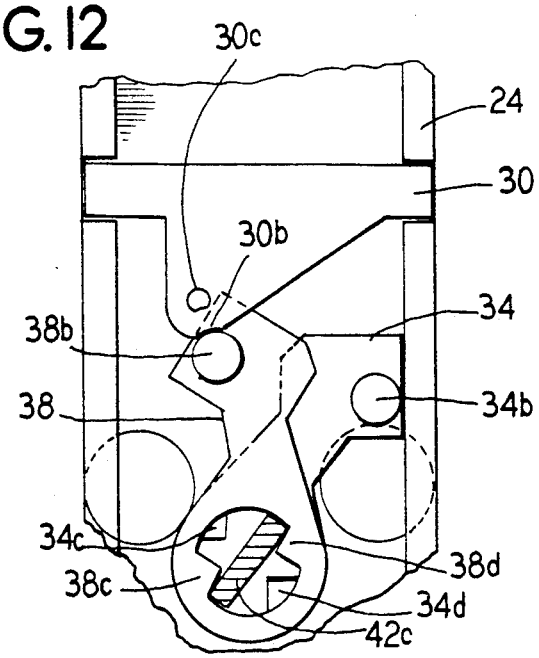
FIG. 12 is an enlarged partial front elevational view of the rod casing assembly of FIG. 9.

FIG. 9 shows the retract actuator 38 rotated further still clockwise. This further rotation occurs against a resilient deformation force of the cam 30. An exemplary material chosen for the retract cam 30 is polycarb LNP-4010 white or natural as this material allows a small amount of resilient compression. As FIG. 12 shows, this resiliency allows for some deformation along an area of contact 30*b* at a trailing end of the cam 30. Additionally, a hole 30*c* is formed into the cam 30 near to the point of contact 30*b* with the retract actuating pin 38*b* which assists, by removing material from the retract cam 30, in this resilient compression of the retract cam 30. This resilient compression provides two benefits, first, it holds or grips the retract actuator firmly in the dogging position or the latch retract position even during the shock and impact that occurs as the door opens and closes to the door frame. Secondly, an additional benefit is that the resilient compression force to be overcome to dog the cam 30 prevents the cam 30 and the retract actuator 38 from accidentally engaging into a dogged or latch retract position at an incorrect time.

FIG. 10 shows the operation for removing the assembly from the dogged position or the latch retract position as shown in FIG. 9. As shown in FIG. 10, the lock/unlock actuator 34, which is arranged behind the latch retract actuator 38 on the cylinder hub 42, interferes with the latch retract actuator 38 by abutting the latch retract actuator 38 with the lock actuating pin 34*b*. This pushes the latch retract actuator counter clockwise past the spring-like resilient capture of the cam 30. After the latch retract actuator has passed the cam 30 the assembly reverts to the undogged or latch activated condition. FIG. 11 shows the assembly fully returned to this condition.

FIG. 12 explains the relationship between the spindle piece 42*c* and the latch retract actuator 38 and the lock-/unlock actuator 34. Each of the latch retract actuator 38 and the lock/unlock actuator 34 comprises two corners formed into the interior of the respective apertures 34*a*, 34*b*. The apertures 34*a*, 34*b* are otherwise circular. These corners are arranged to allow approximately 90° of freedom for the spindle piece 42*c* within the apertures 34*a*, 34*b*. The latch retract actuator 38 provides corners 38*c* and 38*d* respectively and the lock/unlock actuator provides corners 34*c*, 34*d* respectively. The arrangement of these corners with the spindle piece 42*c* provides that each of the actuators 34, 38 has approximately 90° of rotational play with regard to the movement of the spindle 42*c* within the respective apertures 38*a*, 34*a*.

With regard to the movement of the mechanism from FIG. 6 to the condition of FIG. 8, when the spindle piece 42*c* is turned clockwise from the condition of FIG. 6 the latch retract actuator 38 moves clockwise before the lock/unlock actuator begins to move clockwise because of the 90° play of the spindle piece 42*c* and the arrangement of the corners 34*c*, 34*d*. Thus, the latch retract actuator 38 is able to underlie the cam surface 30*a* before the cam surface 30*a* proceeds downwardly to any great extent.

Figure 13:
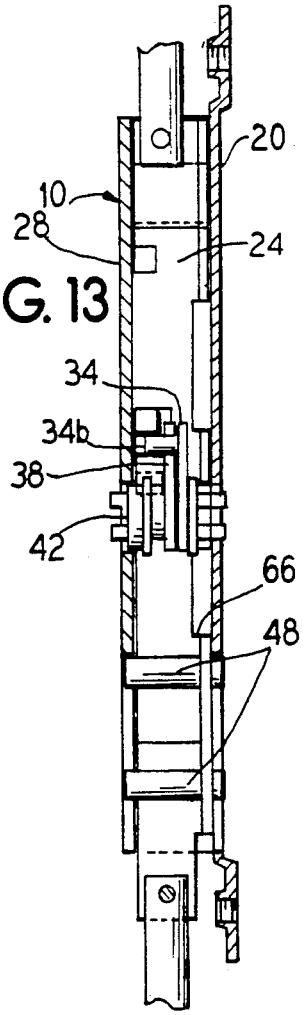
FIG. 13 is a sectional view of the rod casing assembly of FIG. 11 taken generally along line XIII—XIII.

FIG. 13 shows in sectional view the casing assembly 10 including the arrangement of the actuators 34, 38 on the cylinder hub 42. The cover piece 28 is shown mounted to a top of the chassis 20. The cylinder hub 42 is shown mounted through the open back portion 66 of the rod slide 24. Thus, the rod slide 24 can proceed up and down axially without interfering with the cylinder hub 42. The pins 48 are shown in place through the cover 28 and chassis 20.

The rod slide, actuators and other hardware are preferably made of steel or other known metals for door hardware applications.

Although the present invention has been described with reference to a specific embodiment, those of skill in the art will recognize that changes may be made thereto without departing from the scope and spirit of the invention as set forth in the appended claims.

I claim as my invention:

1. A casing assembly for mounting into a door stile of a door fitted into a door frame, the assembly operable by a user for disengaging at least one latch protruding from the door stile from the door frame, the assembly comprising:

a chassis mounted to the door stile;

an actuator means for retracting the latch from the door frame, said actuator means mechanically connected to said latch, said actuator means slidably mounted to said chassis for vertical movement with respect to said chassis, said actuator means having a trailing portion thereon;

a delatch means mounted to said chassis but having at least one degree of freedom for movement, said delatch means movable to underlie said trailing portion for dogging said actuator means in a vertically raised position;

a lock/unlock means mounted to said chassis having at least one degree of freedom for movement and having an abutment portion engageable with the trailing portion of said actuator means for imparting an upward thrust on said actuator means when said lock/unlock means is selectively moved; and a rotation means, mounted to said chassis, for receiving a selective rotation force from the user and for selectively moving said lock/unlock means and said delatch means.

2. A casing assembly according to claim 1, wherein movement of said delatch means and said lock/unlock means is a rotation movement.

3. An assembly according to claim 2, wherein said delatch means and said lock/unlock means are mounted for rotation to said chassis about a common axis.

4. An assembly according to claim 3, wherein said rotation means is mounted to said chassis having a rotational axis aligned with said rotation axis of said delatch means and said lock/unlock means.

5. An assembly according to claim 4, wherein said trailing portion of said actuator means comprises a cam surface engageable by said lock/unlock means and a rounded surface engageable by said delatch means.

6. An assembly according to claim 1, wherein said trailing portion of said actuator means comprises a resilient portion which deforms when engaged by said delatch means.

7. A casing assembly for mounting into a door stile of a door fitted into a door frame, the assembly operable by a user for disengaging at least one latch protruding from the door stile from the door frame, the assembly comprising:

a chassis mounted to the door stile:

an actuator cam having a cam surface, said cam movable vertically with respect to said chassis and mechanically communicating with the latch to disengage the latch from the door frame;

a delatch actuator rotatably mounted to said chassis and rotatable to engage said actuator cam for dogging the actuator cam in a vertically raised position;

a lock/unlock actuator rotatably mounted to said chassis, having an abutment portion engageable with the cam surface of the actuator cam when said lock/unlock actuator is rotated; and a rotation mechanism mounted to said chassis for receiving a mechanical force from the user, said mechanism engageable to said lock/unlock actuator and to said delatch actuator, rotation of said rotation mechanism thereby causing selective rotation of said lock/unlock actuator and said delatch actuator.

8. An assembly according to claim 7, wherein said rotation mechanism comprises an axially rotatable spindle piece, and said delatch actuator comprises a contact portion at a distal end and an aperture at a base end, said aperture surrounding said spindle piece of said rotation mechanism, said delatch actuator selectively rotatable by said spindle piece, said contact portion engageable under a trailing portion of said actuator cam to hold said actuator cam in the vertically raised position.

9. An assembly according to claim 8, wherein said lock/unlock actuator comprises said abutment portion at a distal end and an orifice at a base end surrounding said spindle piece and selectively rotatable by rotation of said spindle piece.

10. An assembly according to claim 9, wherein said orifice comprises a circular opening except for two corner portions extending into said circular opening which permit free rotation of said spindle piece in said orifice for approximately 90°.

11. An assembly according to claim 9, wherein said abutment portion comprises a horizontally arranged pin.

12. An assembly according to claim 11, wherein said pin and said orifice are arranged for interference of said pin with said delatch actuator to displace said delatch actuator from engagement with said actuator cam upon rotation of said lock/unlock actuator toward said delatch actuator.

13. An assembly according to claim 12, wherein said orifice and said aperture are configured for selective rotation of said spindle piece wherein said abutment portion of said lock actuator lifts said actuator cam to the vertically raised position when said spindle piece is rotated in a first rotational direction and thereafter allows rotation of said spindle piece in a second rotational direction without releasing said actuator cam from said lock/unlock actuator abutment portion until said delatch actuator is positioned abutting said trailing portion with said actuator cam in a lifted position.

14. An assembly according to claim 8, wherein said aperture comprises a circular opening except for two corner portions extending into said circular opening which permit free rotation of said spindle piece in said aperture for approximately 90°.

15. An assembly according to claim 8, wherein said actuator cam is composed of a resilient material.

16. An assembly according to claim 15, wherein said actuator cam comprises a hole formed through said actuator cam at said trailing portion for removing material and increasing compressive resilience of said trailing portion.

17. An assembly according to claim 15, wherein said actuator cam provides an inclined cam surface sloping downwardly into said trailing portion, said trailing portion comprising a rounded downwardly extending protuberance.

18. An assembly according to claim 17, wherein said arrangement further comprises a latch rod, and a rod slide, said rod slide mounted with said actuator cam and slidable vertically within said chassis, said rod slide connected to a latch rod which extends vertically to said latch.

19. An assembly according to claim 18, wherein said assembly further comprises a cover mounted to said chassis and capturing said rod slide between said cover and said chassis, said spindle piece supported for rotation on said cover and on said housing.

20. An assembly according to claim 19, wherein said rod slide is mounted to said chassis and said cover by at least one pin member, said chassis and said cover providing slots for said pin member to progress vertically through said slots with said rod slide.

21. An assembly according to claim 19, wherein said spindle member is capped at opposite ends by hub portions which are rotatably held at said cover and at said chassis.

22. An assembly according to claim 18, wherein said rod slide provides a slot along a width of said rod slide and said actuator cam provides a bar portion fittable into said slot to fix said actuator cam with respect to said rod slide, for axial movement therewith.

23. An assembly according to claim 7, wherein said rotation mechanism comprises a key-activated lock cylinder.

24. An assembly according to claim 7, wherein said actuator cam is composed of a resilient material.

25. A casing assembly for mounting into a door stile of a door fitted into a door frame, the assembly operable by a user for disengaging at least one latch protruding from the door stile from the door frame, the assembly comprising:

a chassis mounted to the door stile;

an actuator cam having a cam surface, said cam movable vertically with respect to said chassis and mechanically communicating with the latch to disengage the latch from the door frame;

a delatch actuator rotatably mounted to said chassis, said delatch actuator having a contact pin at a distal end and an aperture at a base end, and rotatable to be engageable under a trailing portion of said actuator cam to hold said actuator cam in a vertically raised position;

a lock/unlock actuator rotatably mounted to said chassis, having an abutment pin at a distal end and an orifice at a base end, said abutment pin slidably abuttable along the cam surface of the actuator cam when said lock actuator is rotated; and a rotation mechanism for receiving a mechanical force from the user, said mechanism having an axially rotatable spindle piece receiving said mechanical force, said aperture and said orifice surrounding said spindle piece and pierced by the rotational axis of said spindle piece, said spindle piece causing selective and independent rotation of said lock/unlock actuator and said delatch actuator.

26. An assembly according to claim 25, wherein said orifice and said aperture comprise circular openings each having two intruding portions extending into each circular opening, the intruding portions arranged to allow limited rotational travel of the spindle piece within each of said aperture and said orifice.

27. An assembly according to claim 26, wherein said limited rotational travel comprises approximately 90°.

28. An assembly according to claim 26, wherein said abutment pin, said orifice and said aperture are configured and arranged for said abutment pin to interfere with said delatch actuator to displace said delatch actuator from under said actuator cam upon rotation of said lock/unlock actuator toward said delatch actuator.

29. An assembly according to claim 26, wherein said actuator cam is composed of a resilient material and said contact pin deforms a trailing portion of said actuator cam when said delatch actuator is rotated for said contact pin to underlie said trailing portion of said actuator cam.

* * * * *